US009163465B2

(12) United States Patent
Keller et al.

(10) Patent No.: US 9,163,465 B2
(45) Date of Patent: Oct. 20, 2015

(54) SYSTEM AND METHOD FOR DRILLING A WELL THAT EXTENDS FOR A LARGE HORIZONTAL DISTANCE

(76) Inventors: Stuart R. Keller, Houston, TX (US); Adel H. Younan, Sugar Land, TX (US); Mark C. Gentry, The Woodlands, TX (US); Timothy J. Nedwed, Houston, TX (US); Bruce A. Dale, Sugar Land, TX (US)

( * ) Notice: Subject to any disclaimer, the term of this patent is extended or adjusted under 35 U.S.C. 154(b) by 617 days.

(21) Appl. No.: 13/505,217

(22) PCT Filed: Sep. 28, 2010

(86) PCT No.: PCT/US2010/050534

§ 371 (c)(1), (2), (4) Date: Apr. 30, 2012

(87) PCT Pub. No.: WO2011/071586

PCT Pub. Date: Jun. 16, 2011

(65) Prior Publication Data

US 2012/0234551 A1 Sep. 20, 2012

Related U.S. Application Data

(60) Provisional application No. 61/285,410, filed on Dec. 10, 2009, provisional application No. 61/334,333, filed on May 13, 2010.

(51) Int. Cl.

| | |
|---|---|
| ***E21B 7/12*** | (2006.01) |
| ***E21B 7/04*** | (2006.01) |
| ***E21B 21/00*** | (2006.01) |
| ***E21B 21/08*** | (2006.01) |
| ***E21B 21/12*** | (2006.01) |

(52) U.S. Cl.

CPC ..... *E21B 21/001* (2013.01); *E21B 21/08* (2013.01); *E21B 21/12* (2013.01)

(58) Field of Classification Search

CPC ..... E21B 7/12; E21B 7/043; E21B 21/001; E21B 21/08

USPC ..... 166/347, 349, 352, 358, 367, 117.5, 166/241.1, 901; 175/5, 48, 61, 62; 405/224.2, 224.3

See application file for complete search history.

(56) References Cited

U.S. PATENT DOCUMENTS

| | | | | |
|---|---|---|---|---|
| 3,661,204 | A | 5/1972 | Blanding et al. | |
| 4,063,602 | A * | 12/1977 | Howell et al. | 175/7 |
| 4,176,985 | A * | 12/1979 | Cherrington | 405/184 |

(Continued)

FOREIGN PATENT DOCUMENTS

GB 2365044 2/2002

OTHER PUBLICATIONS

Lopes, C.A., et al. (1997), "The Dual Density Riser Solution," SPE37628, Drilling Conf., Amsterdam, The Netherlands, Mar. 4-6, 1997, pp. 1-9.

(Continued)

*Primary Examiner* — Matthew Buck

(57) ABSTRACT

Method and apparatus for extending the horizontal distance through which wells can be drilled. A horizontal tubular is used to convey a drillstring from a drilling rig toward a target location and a mud return line and pump on the surface is used to pump drilling mud returning from the bit back to the drilling rig.

28 Claims, 10 Drawing Sheets

(56) References Cited

U.S. PATENT DOCUMENTS

| | | | | |
|---|---|---|---|---|
| 4,223,737 | A * | 9/1980 | O'Reilly | 166/336 |
| 4,224,989 | A * | 9/1980 | Blount | 166/400 |
| 4,428,441 | A | 1/1984 | Dellinger | |
| 4,458,767 | A * | 7/1984 | Hoehn, Jr. | 175/61 |
| 4,700,788 | A * | 10/1987 | Langner | 175/61 |
| 4,813,495 | A | 3/1989 | Leach | |
| 5,131,477 | A * | 7/1992 | Stagg et al. | 175/40 |
| 5,486,070 | A | 1/1996 | Huete | |
| 5,839,520 | A * | 11/1998 | Maillet | 175/61 |
| 6,415,877 | B1 | 7/2002 | Fincher et al. | |
| 6,571,873 | B2 * | 6/2003 | Maus | 166/250.07 |
| 6,591,903 | B2 * | 7/2003 | Ingle et al. | 166/50 |
| 6,601,656 | B2 * | 8/2003 | Hopper et al. | 175/5 |
| 6,668,943 | B1 | 12/2003 | Maus et al. | |
| 6,854,532 | B2 | 2/2005 | Fincher et al. | |
| 6,932,168 | B2 * | 8/2005 | Morgan et al. | 175/62 |
| 7,025,144 | B2 * | 4/2006 | Haugen et al. | 166/313 |
| 7,032,658 | B2 * | 4/2006 | Chitwood et al. | 166/61 |
| 7,048,470 | B2 * | 5/2006 | Anres | 405/163 |
| 7,100,687 | B2 * | 9/2006 | Pauley | 166/245 |
| 7,114,581 | B2 | 10/2006 | Aronstam et al. | |
| 7,189,029 | B2 | 3/2007 | Pionetti | |
| 7,228,918 | B2 * | 6/2007 | Evans et al. | 175/61 |
| 7,264,048 | B2 * | 9/2007 | Zupanick et al. | 166/245 |
| 7,571,777 | B2 | 8/2009 | Wylie et al. | |
| 7,757,784 | B2 | 7/2010 | Fincher et al. | |
| 7,789,162 | B2 | 9/2010 | Keller et al. | |
| 7,938,190 | B2 | 5/2011 | Talamo et al. | |
| 8,011,450 | B2 | 9/2011 | Krueger et al. | |
| 2003/0051880 | A1 * | 3/2003 | Hopper | 166/366 |
| 2003/0075335 | A1 * | 4/2003 | Amin et al. | 166/350 |
| 2003/0217866 | A1 | 11/2003 | deBoer | |
| 2006/0065402 | A9 * | 3/2006 | Fontana et al. | 166/358 |
| 2007/0034409 | A1 * | 2/2007 | Dale et al. | 175/61 |
| 2008/0115975 | A1 * | 5/2008 | Coppola | 175/61 |

OTHER PUBLICATIONS

Eggemeyer, J.C., et al., (2001), "SubSea MudLift Drilling: Design and Implementation of a Dual Gradient Drilling System," SPE71359, Ann. Tech. Conf. and Exh, New Orleans, LA, Sep. 30, 2001, pp. 1-18.

Fossil, B., et al., (2004), "Managed Pressure Drilling for Subsea Applications; Well Control Challenges in Deep Waters," SPE 91633, Underbalanced Tech. Conf. and Exh., Houston, TX, Oct. 11-12, 2004, pp. 1-10.

Kozicz, J. R., et al. (2006), "Integrating Emerging Drilling Methods From Floating Drilling Rigs—Enabling Drilling Solutions for the Future," SPE99135, Drilling Conf., Miami, FLA, Feb. 21-23, 2006, pp. 114.

Smith, K. L., et al., (2001), "SubSea MudLift Drilling Joint Industry Project: Delivering Dual Gradient Drilling Technology to Industry," SPE71357, Ann. Techn. Conf. and Exh., New Orleans, LA, Sep. 30, to Oct. 3, 2001, pp. 1-13.

* cited by examiner

SYSTEM AND METHOD FOR DRILLING A WELL THAT EXTENDS FOR A LARGE HORIZONTAL DISTANCE

CROSS-REFERENCE TO RELATED APPLICATIONS

This application is the National Stage of International Application No. PCT/US10/50534, filed Sep. 28, 2010, which claims the benefit of U.S. Provisional Application No. 61/285,410, filed Dec. 10, 2009, and U.S. Provisional Application No. 61/334,333, filed May 13, 2010, the entirety of both which are incorporated herein by reference for all purposes.

FIELD

The present invention relates to drilling wells that extend for a large horizontal distance between the surface location of the well and the bottom portion of the well. More particularly, apparatus and method are provided for decreasing the pressure of drilling fluid at the bottom of the hole as the well is drilled to the large horizontal distance and to facilitate extended horizontal reach between the location of a drilling or other vessel/facility and a subsea wellbore.

BACKGROUND

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of prior art.

Extended Reach Drilling (ERD) often reduces field development costs for hydrocarbons because it allows remote reserves to be accessed from a surface location that allows a lower-cost drilling unit to be used than would be required to drill a vertical well to the hydrocarbon reservoir. For example, a significant portion of the Chayvo field in Russia has been developed using a land-based rig to drill more than 15 10-km-throw wells ("throw" is the horizontal distance from surface to bottom-hole location) rather than drilling from a more costly offshore Arctic drilling platform. The current reach (throw) record of a well is about 12 km, but 15-km-reach wells are reportedly being planned. There is a growing need to dramatically increase the reach capability for ERD even beyond 15 km. For example, for a deepwater prospect in the Arctic, in an area where crushing sea ice may limit seasonal drilling windows to a few weeks per year, it may take two or three years to drill a well. This significantly hurts the economics of the prospect. If the heart of the prospect is about 30 km away from shallow (<60 m) water, for example, an ERD well with a throw of 30 km drilled from a bottom-founded platform that allows year-round drilling could significantly improve the economics of appraising and developing the field. In fact, 30-km ERD capability could potentially be enabling for field development.

There are two main technical challenges in constructing long ERD wells: (1) torque and drag forces on the drill string and (2) equivalent circulating density (ECD) of the drilling fluid (mud). Torque and drag can be reduced by rotating the drill string, using lighter-weight materials for the tubulars, floating-in casing and liners, adding lubricants in the surrounding fluid and/or using mechanical devices (e.g., roller centralizers). By one or combinations of such techniques, based on results from ERD wells and predictive calculations, torque and drag can be controlled such that it does not limit ERD in many environments, even to a throw of 30 km or more.

The limiting parameter in drilling many ERD wells is "delta ECD." The pressure outside the bit required to flow the mud back to the surface is called "Equivalent Circulating Density" (ECD). As the well measured depth increases and as the casing/liner strings get smaller, the ECD increases even more above the pressure that would be exerted outside the bit if the mud were not circulating. This increase, called here "delta ECD," is caused by fluid frictional pressure. The delta ECD in some ERD wells while drilling 8½-inch hole through 9 km of 9⅝-inch casing was measured at about 4 ppg (pounds per gallon). Based on this, for a similar geometry, a 30-km well would have more than 12 ppg in delta ECD, which is unacceptably high. If the ECD is too high, the well will lose returns and cuttings will build up, eventually causing the Bottom Hole Assembly (BHA) to become stuck. This is a costly problem that typically would cause the well to be abandoned. The ECD issue can be mitigated by using liners, but typically the liners would have to be set in a full casing string (typically 13⅜-inch OD) that could withstand kick pressures. The reduced ID of the full casing string compared to the conductor means that ECD would likely still be a major problem.

Others have tried to solve the delta ECD problem in a variety of manners, for example, using well architecture to maximize the annular area, reducing the viscosity of the mud, using managed pressure drilling, using a downhole pump incorporated into the drill string, and using various forms of "dual gradient" drilling. Well architecture may maximize the size of the annular area. This will reduce the annular fluid frictional pressure losses, but drilling large diameter wells have several drawbacks. Using small diameter drill pipe also has drawbacks.

Generally, using a low viscosity mud will reduce ECDs. Several approaches have been tried, including using mud weighted with micro-sized barite rather than conventional sized barite, but lower viscosity mud reduces hole-cleaning effectiveness.

Managed Pressure Drilling (MPD) is a technique whereby the return mud flows through a choke that provides a back pressure on the annulus. This allows a lighter mud weight to be used. Generally muds with lower densities have lower viscosities, and thus the delta ECD can be somewhat reduced. However, MPD is complicated and expensive to implement.

At least one service company has performed research on a downhole annular mud pump that is incorporated into the drill string, which is described in "A Downhole Tool for Reducing ECD," Amer. Association of Drilling Engineers, AADE-07-NTCE-69 (2007). In this apparatus, the pump takes suction from the mud below the pump and pumps the annular fluid above the pump to the surface. This reduces the pressure seen by the formation at total depth (TD). The idea of using a pump to reduce the pressure at TD has merit, but incorporating a pump into the drill string is fraught with problems. First, when pulling upwards, the pump may create a swab pressure that may induce wellbore instability or formation fluid influx. Second, the pump represents a potential hazard to well control because it cannot be easily stripped through the blowout preventers. Also, the current design uses the downward fluid flow as an energy source to drive the pump, and this saps horsepower from the rig pumps. In addition, the pump must be placed inside casing and has rotating seals that are a prime failure point.

There have been a number of attempts to reduce annular pressures (and therefore ECDs) in deepwater wells using the concept of dual gradient drilling (DGD). In DGD, pumping is used to help lift the mud returns from the sea floor. In some cases, pumps placed either on or near the sea floor or suspended in the water column are used to lift the mud back to the rig. For example, Smith et. al. (SPE 71357) describe a subsea mud lift system for reducing annular mud pressures. This system incorporates a mud pump that is placed on the sea floor. U.S. Pat. No. 6,854,532 discloses a suction pump coupled to the annulus. Examples of suspended pump systems include the Ocean Riser Drilling System discussed by Fossli (SPE 91633). Other DGD methods include injecting a lightweight fluid (sometimes containing hollow beads) into the drilling riser above the blowout preventer (BOP) (e.g., SPE 99135). These systems often use the riser boost line or a concentric riser string to pump into the return mud stream and inject a lightweight gas or liquid.

The DGD systems can lower the bottomhole pressure and ECD by lowering pressure at the mudline, but the bottomhole pressure will still be affected by the long interval (measured depth) below the mudline in ERD wells, i.e., by the annular frictional pressure losses from the bottom of the borehole to the mudline.

What is needed is apparatus and method for decreasing the ECD in long ERD wells. The method should be applicable in onshore or offshore wells in any water depth.

It is also desirable to provide extended horizontal reach such that the location of a drilling or other operations vessel or facility and the subsea bottom-surface location of a well each may be remotely placed from each other to permit continuous year-around or extended working seasons in the wellbore from the facility. Previously known technology may relegate vessel or facility locations to areas that are subject to sea ice, especially icebergs, that limit arctic well operations to intermittent or seasonal activities.

The foregoing discussion of need in the art is intended to be representative rather than exhaustive.

SUMMARY

The present invention discloses apparatus and method for avoiding high pressure-losses that occur in the drilling mud flowing back to surface in a well drilled a long horizontal distance through the earth (an "Extended Reach Well"). A "horizontal tubular" is installed from a drilling rig to a selected location in the direction that an Extended Reach Well is to be drilled. The horizontal tubular can be used for conveying the drill bit and drill string to the selected location, which will be selected to be nearer the desired bottom hole location than the drilling rig. A mud return line and pump may be installed outside the horizontal tubular for bringing drilling mud back to the surface, preferably alongside the horizontal tubular. The mud return line may be connected to the horizontal tubular through a port near the distal end of the tubular. One or more wells may be directionally drilled from the distal end of the tubular. After drilling to an intermediate depth for each well, with mud returns being pumped through the mud return line, a first casing string, having a port, is placed in the well. Drilling fluid may then flow from inside the first casing string to the mud return line through the ports in the casing string and in the horizontal tubular. The horizontal tubular preferably extends across the majority of the horizontal displacement or throw of the well. Control of the pump in the mud return line allows pressure to be controlled at the port in the first casing. Other sections of the well may then be drilled by successfully drilling and cementing liners in the drilled sections. In one embodiment, two tubulars may extend from a structure having two drilling rigs, along with two pumps and mud return lines outside the tubulars. Such installation may be used for drilling relief wells from the structure in addition to the primary well. In another embodiment, the lower sections of an offshore well may be drilled after upper sections have been drilled using another drilling rig, which may be on an offshore vessel. In one embodiment, a sacrificial inner string, which may be replaceable, is placed at selected locations in a casing to prevent excessive wear during drilling.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE SEVERAL VIEWS OF THE DRAWINGS

The novel features that are believed to be characteristic of the invention, both as to its organization and method of operation, together with further objects and advantages will be better understood from the following description when considered in connection with the accompanying figures. It is to be expressly understood, however, that each of the figures is merely exemplary and provided for the purpose of illustration and description only, and is not intended as a definition of the limits of the present invention.

It should be noted that the figures are merely exemplary of several embodiments of the present invention and no limitations on the scope of the present invention are intended thereby. Where considered appropriate, reference numbers may be repeated among the drawings to indicate corresponding or analogous elements. Further, the figures are merely exemplary and generally not drawn to scale, but are drafted for purposes of convenience and clarity in illustrating various aspects of the invention.

DETAILED DESCRIPTION

Reference will now be made to exemplary embodiments and specific language will be used to describe the same. It will nevertheless be understood that no limitation of the scope of the invention is thereby intended. Alterations of further modifications of the inventive features described herein, and additional applications of the principles of the invention as described herein, which would occur to one skilled in the relevant art and having possession of this disclosure, are to be considered within the scope of the invention. Further, before particular embodiments of the present invention are disclosed and described, it is to be understood that this invention is not limited to the particular process and materials disclosed herein as such may vary to some degree. It is also to be understood that the terminology used herein is used for the purpose of describing particular embodiments only and is not intended to be limiting, as the scope of the present invention will be defined only by the appended claims and equivalents thereof.

Figure 1A:
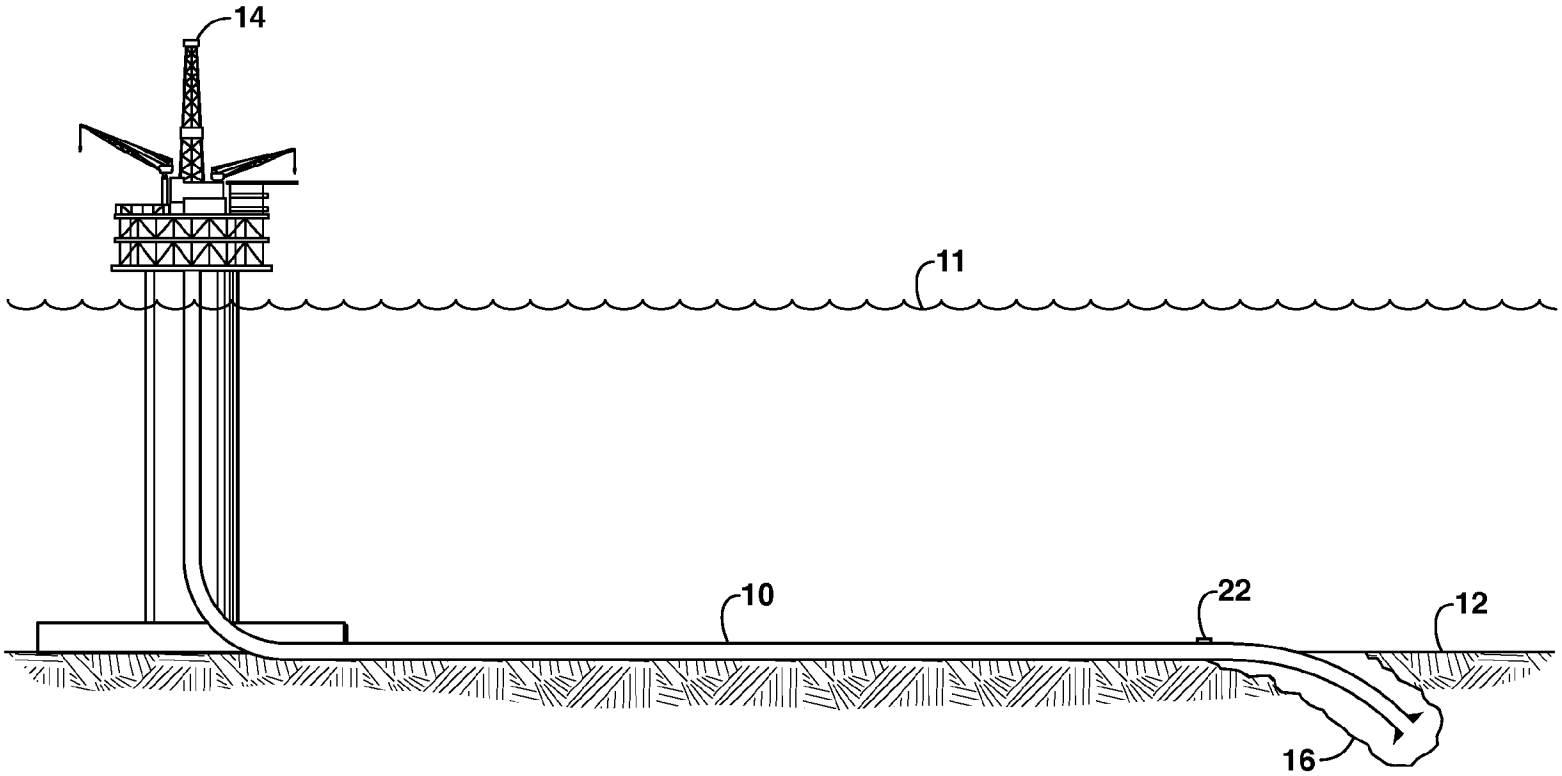
FIG. 1*a* illustrates a horizontal tubular at the mudline (e.g., seafloor) to be used for Extended Reach Drilling (ERD) of an offshore well from a platform drilling rig.

FIG. 1*a* illustrates horizontal tubular 10 placed at the mudline 12 under a body of water 11 and brought to a vertical direction at drilling rig 14. The horizontal tubular may be assembled onshore and towed to the location or installed using a pipeline installation barge or other pipeline installation techniques well known in industry. A horizontal tubular is a tubular structure that is oriented primarily or substantially in a horizontal direction and that may arc vertical or bend at an intermediate angle at each end, and/or along the length of the tubular. The term "horizontal tubular" is defined broadly herein to mean a tubular body that is oriented not only along a seafloor and that is substantially parallel with the water surface or seafloor, but also includes following a path having horizontal displacement and at an angle with respect to the water surface, the angle being in a range of from substantially zero (0) degrees with respect to the water surface (e.g., substantially parallel with the water surface) to forty-five (45) degrees with respect to the water surface. Such orientations thus include tubular positions that are disposed on or near the seafloor and including orientation angles that may follow or diverge from the sea floor, such as angles of up to forty-five (45) degrees with respect to the water surface. In many aspects, the horizontal tubular is disposed below the water surface (e.g., subsea, commonly on or along the sea floor or mudline). (A common use of horizontal tubulars in industry is as a pipeline, to convey fluids between points spaced apart on or near the surface of the earth, including points under water.) The curvature in horizontal tubular 10 where it turns from vertical to horizontal is preferably limited to minimize torque and drag as a drillstring or casing strings pass through the curved portion. If the proximal end of the horizontal tubular is on an offshore rig, the horizontal tubular can be brought to the rig drilling floor using a catenary drilling riser. Conventional tow or J-lay or S-lay technology can be used. Horizontal tubular 10, having port 22 (to be explained below), preferably extends horizontally from rig 14 in the direction of the desired location of the bottom of a wellbore. Although the horizontal tubular is shown at the mudline, it can be placed below the mudline by forming a trench (not shown) before laying the horizontal tubular. The depth of a trench can be selected to allow the horizontal tubular to be below the zone that could be affected by gouging of ice into the seafloor 12. The horizontal tubular may also be near ground level on land. The length of the horizontal tubular can be selected to reach a location such that a well can be drilled using a drill string exiting the end of the horizontal tubular to reach a desired target location in the earth. The length of the horizontal tubular may be, for example, in the range from about 15 km or less to about 60 km or more. For example, if the water depth is 12 km, the measured depth (MD) of the well is 120 km and the throw is 60 km, the systems now in use in industry can only reduce the pressure from the last 12 km of the well annulus, while the system and method disclosed herein can reduce the pressure from almost 60 km of the well annulus. In essence, with the system disclosed herein, the pump can be placed much closer to the bottom of an ERD well than with the approach now used in industry. The terms "drilling" or "drill" as used herein are defined broadly to include not only the activity of creating a bore or wellbore, but also includes substantially any related or subsequent activity performed within such well bore, including but not limited to drilling activities, completion activities, production activities, and remedial activities that are conducted at least in part through a horizontal tubular member positioned between a surface vessel and the wellbore. The term "vessel," as used herein is defined broadly to also include not only displacement type drill vessels, but also facilities and platforms which may be rested upon a sea floor, an island or other inland or on-shore location.

Figure 1B:
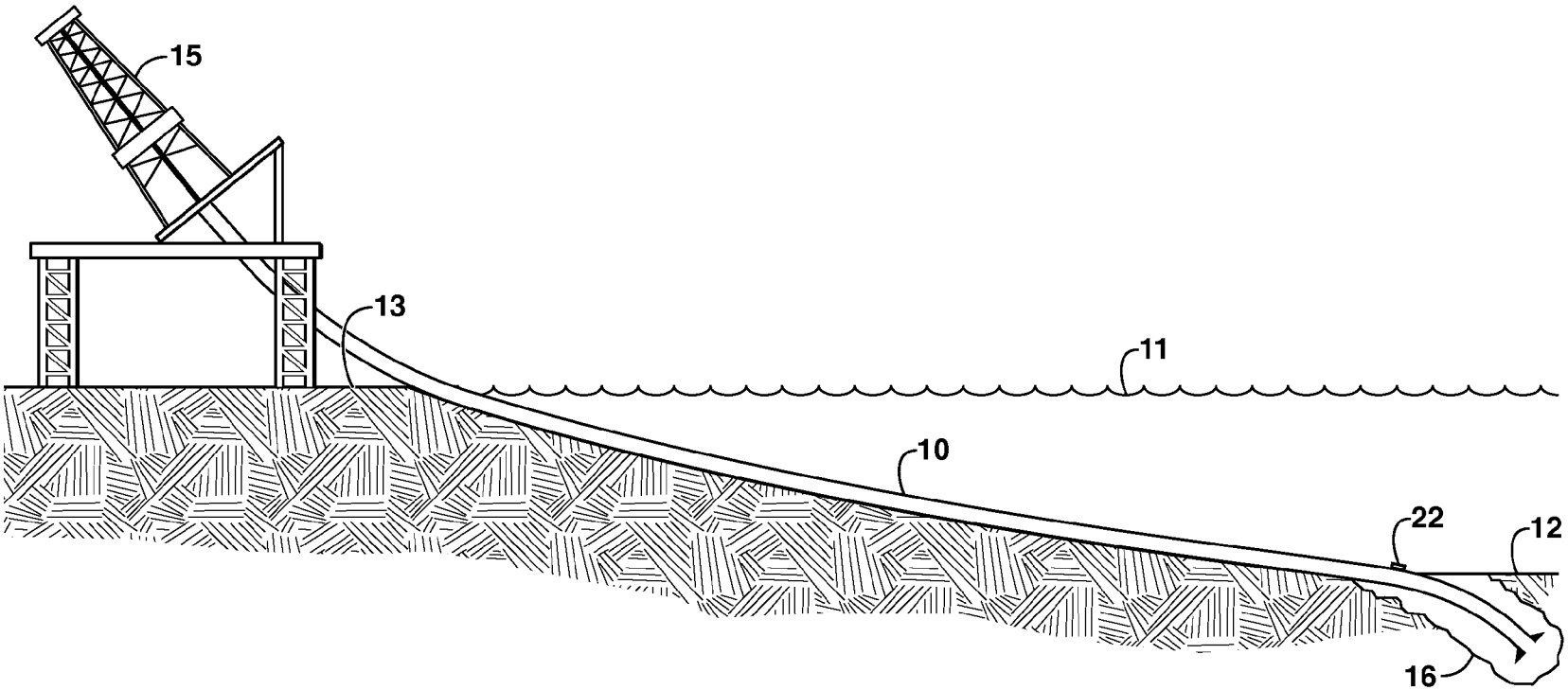
FIG. 1*b* illustrates a horizontal tubular at the mudline to be used for extended reach drilling of an offshore well from a slant rig onshore or on an island.

Offshore wells can be drilled through a horizontal tubular from a vessel, such as drill ship, a floating rig, a land-based rig, a shallow-water platform, a barge, an island, or substantially other location suitable to support such activity. FIG. 1*b* illustrates a slant rig 15, which may be used to facilitate placement of a drillstring into horizontal tubular 10 from land 13 into the seafloor 12 for drilling under a body of water 11. Although not shown in the drawings, rig 15 may also be located on a floating rig, a shallow water platform, or land location.

A horizontal tubular 10 as disclosed herein can serve the purpose of the conductor casing that is normally used in wells. It can have an OD of 20 inches, for example, but other sizes may be used, and different sizes may be used in the same horizontal tubular. The distal end of horizontal tubular 10 may be laid in sloping trench 16, which may be formed before installation of the horizontal tubular, to facilitate starting the drilled portion of the well. Methods for constructing trenches in the sea floor are well known. The wells would be constructed using drill stings, casing strings and liners run through the horizontal tubular or conductor. The hydrocarbon can be produced through a tubing string run through the conductor and production casing and any other casing in the well or can be produced through a gathering pipeline installed separately.

Figure 2A:
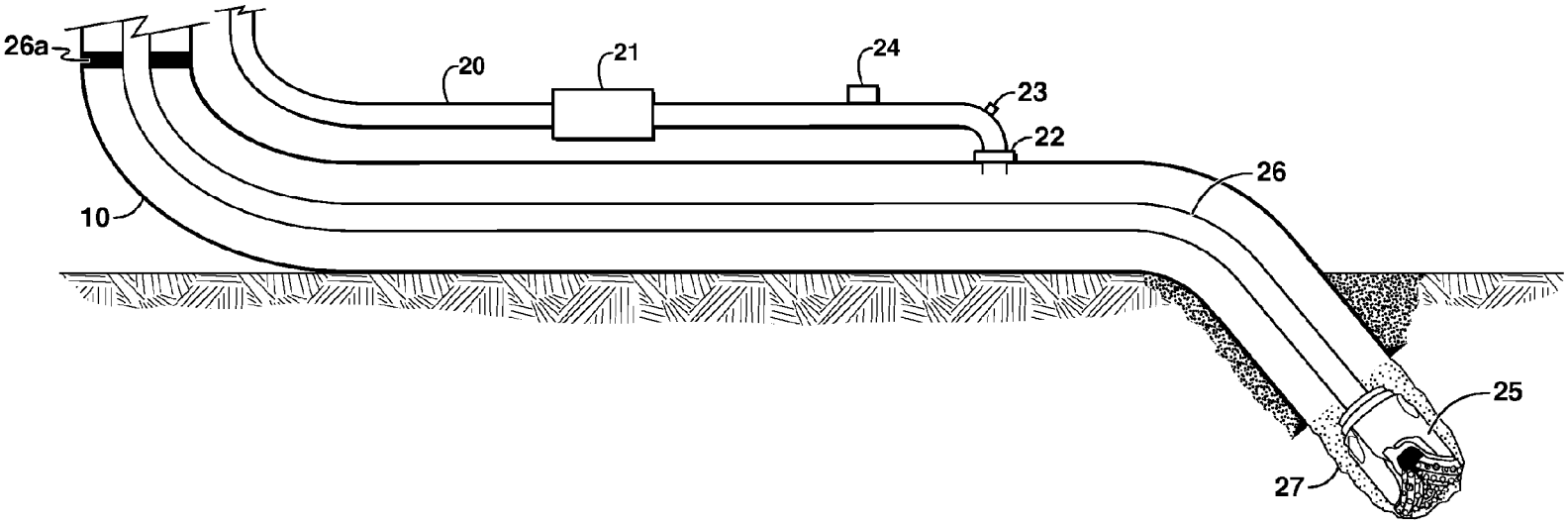
FIG. 2*a* illustrates drilling of a first hole below a horizontal tubular after installation of a mud return line and pump.

FIG. 2*a* illustrates mud return line 20 along with pump 21, which may be installed during horizontal tubular installation. Horizontal tubular 10 includes a port with connectors 22, which may be releasable, for attaching return line 20 when horizontal tubular 10 is in place. Pump 21 in return line 20 can be a progressive cavity pump (PCP). PCPs are well suited for pumping mud and cuttings. Other types of pumps, such as multi-disk pumps, can also be used. Multi-disk subsea pumps for pumping drilling muds have been developed by AGR ASA of Norway for their riserless mud returns system. Pump 21 can be driven by an electric motor or other power source.

Pump 21 can be controlled to have a flow rate less than or equal to the main rig mud pump. Preferably, the rate of pump 21 is manually or automatically controlled to maintain the pressure in tubulars below the pump in a selected range. Pressure sensor 23 may be used to monitor pressure in return line 20. Such pressure may be used to control the rate of pump 21. Flow meter 24 may be used to measure flow rate in return line 20. Other sensors, such as fluid density and conductivity, may be placed in horizontal tubular 10 or return line 20. FIG. 2*a* also illustrates first hole section 27 (typically 17½-inch) that has been drilled using drill bit 25 on drillstring 26 through horizontal tubular 10 to a selected intermediate depth. Drilling fluid and cuttings may be partially or completely returned to surface through return line 20 while drilling of first hole section 27. Rotating blowout preventer 26*a* can be used to isolate the top of the annulus outside drillstring 26 from the atmosphere.

Figure 2B:
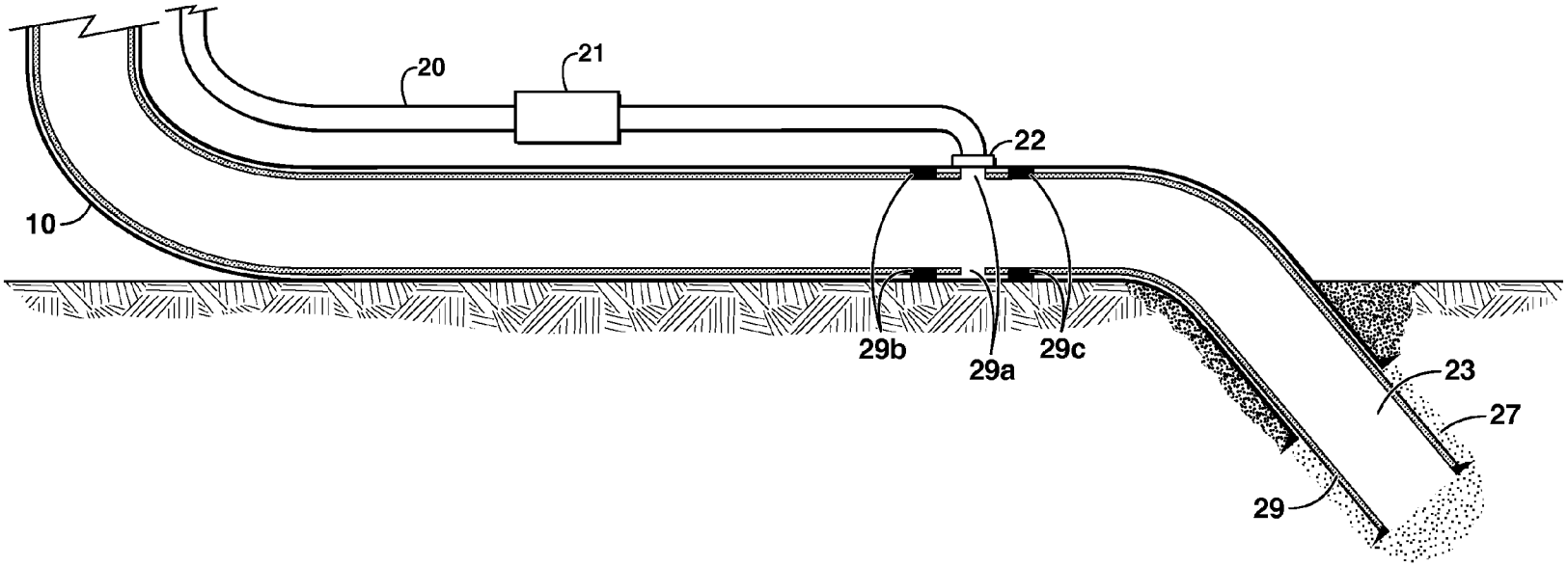
FIG. 2*b* illustrates one embodiment of a well after placement of a first casing string through the horizontal tubular and into the first hole, drilled to a first intermediate depth, and a mud return line and pump.

In FIG. 2*b*, casing 29 (e.g., 13⅜-inch) has been run into first hole section 27 and cemented in place. Casing 29 contains ports 29*a* and preferably packers 29*b* and 29*c*. Casing 29 is placed in horizontal tubular 10 such that ports 29*a* are in fluid communication with return line 20 and are isolated from fluid above and below port 22 by packers 29*b* and 29*c*. Such packers may be a straddle packer and may be hydraulically set.

Figure 3:
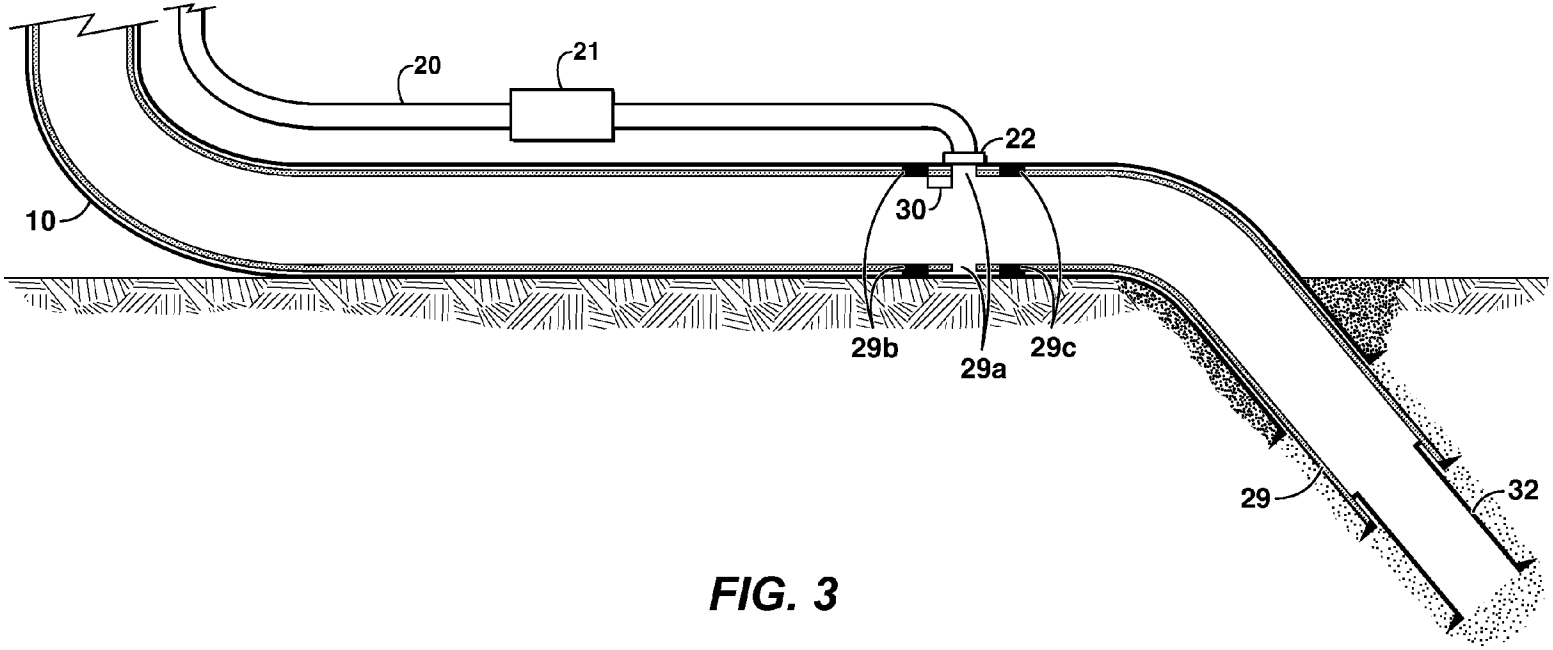
FIG. 3 illustrates one embodiment of the well after placement of a liner string in a second hole, drilled to a second intermediate depth.

In FIG. 3, drillstring 24 and bit 25 (not shown) have been used to drill a second hole section, which is below casing 29, to a second intermediate depth. Drilling fluid and cuttings would normally have been partially or completely returned to surface through ports 29*a* and return line 20 while drilling of the second hole section. Ports 29*a* can be opened or closed by operation of a sliding sleeve or valve 30. Liner 32 has been placed in the second hole section and cemented in place.

Drilling may use a specially designed drill string to minimize torque and drag. The string may incorporate lightweight materials such as aluminum, titanium, composites, or thin-wall high yield strength steel (e.g., 165 ksi yield strength) to reduce side loads. Also the drill string may use mechanical friction reduction devices that incorporate bearings. There are a variety of these devices on the market. In addition, special drilling fluid formulations containing additives to reduce both mechanical and fluid flow friction may be used. These additives are well known to drilling practitioners.

All subsequent casings below casing 29 are preferably run as liners with a liner top packer set below port 29*a* in casing 29. This allows returns to be taken via pump 21 and mud return line 20 on all drilling intervals below casing 29 when port 29*a* is open. The casing or liner strings can be cemented or the annulus outside the strings can be isolated by swell packers, which are well known in industry.

If a kick is taken while drilling, the kick can be circulated out through pump 21 and mud return line 20 or casing 29. Pump 21 should be built to withstand the highest kick pressure expected. Conventional mud motors, an analog to a PCP, are rated to high pressures similar to other drill string components. Mud return line 20 should be attached to the necessary shut-off valves and kick manifold to enable the kick to be safely circulated out. Also, the packers 29*b* and 29*c* should be tested to ensure that they could withstand the highest anticipated differential pressures. As an alternative, port 29*a* can be closed by valve 30 and the kick circulated out using the normal path (between the drill string and the 13⅜-inch casing) and controlled using the conventional surface BOP equipment.

Figure 4:
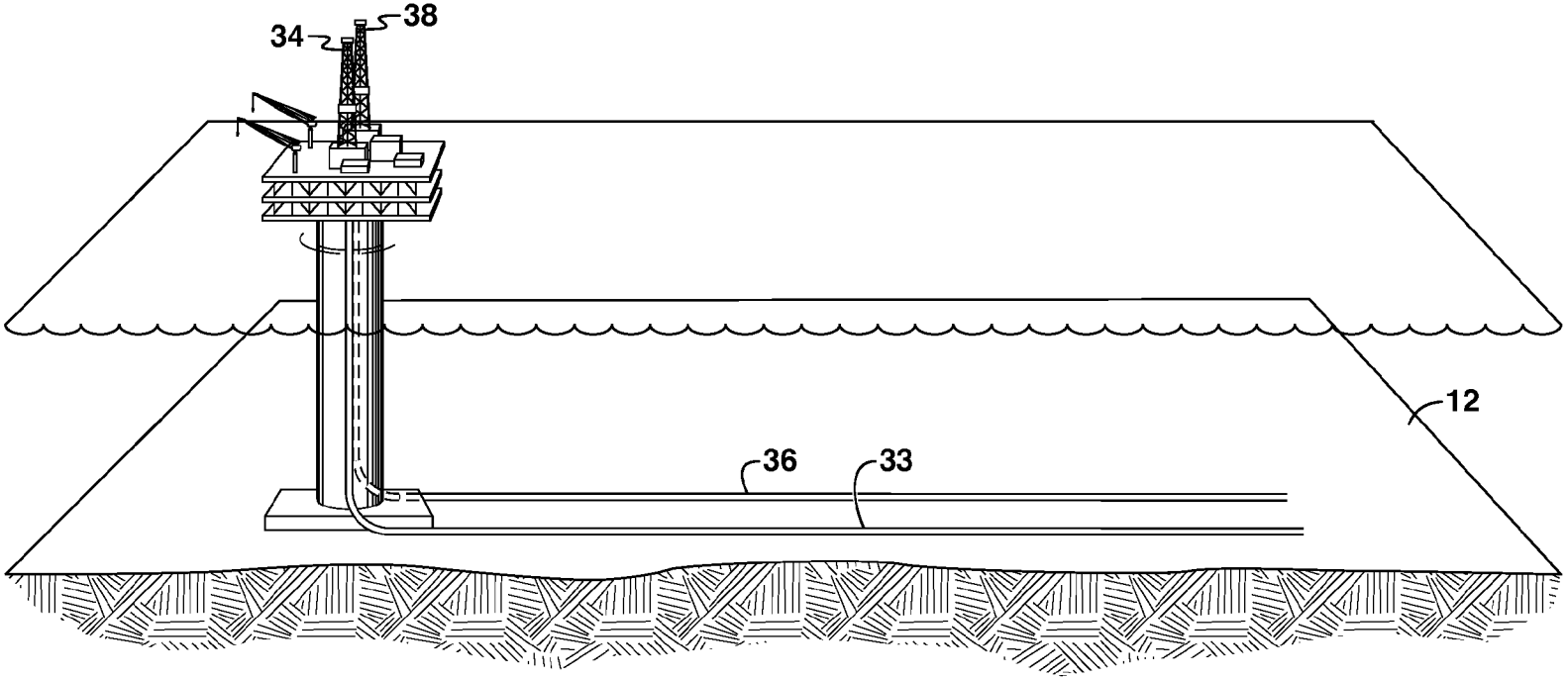
FIG. 4 illustrates an embodiment for drilling a relief well using a second platform drilling rig and two horizontal tubulars for ERD from a single platform.

Apparatus and method described above are used for drilling and completing a single well. One of the main concerns in any Arctic drilling situation is the ability to drill a relief well in the case of loss of well control on an initial well. This is often a key regulatory and company requirement. Typically, this necessitates reasonable access to a second drilling rig. A similar approach was taken at the Hibernia Field, for example, where the relief well requirement was satisfied by having two rigs on a platform. Drilling a relief well can be very challenging in Arctic deepwater environments (where there are few qualified rigs) and it provides a further strain on the economics of Arctic development. The requirement can be satisfied using the method and apparatus disclosed herein by laying two horizontal tubulars, such as horizontal tubular 10 of FIGS. 1 and 2, to the field and having two drilling rigs on the same drilling platform. This arrangement is illustrated in FIG. 4. Horizontal tubular 33 may be used for drilling a first well to a selected bottom-hole location using drilling rig 34. Horizontal tubular 36 may be installed before drilling the first well for use as a conductor for a possible relief well, if needed, to be drilled by rig 38. Also, the horizontal tubular drilling method disclosed herein can serve as the relief well capability for conventional floating drilling. To expedite relief well drilling, the relief well could be pre-drilled down to a predetermined depth to minimize the time to intersect the uncontrolled flow of another well.

Figure 5:
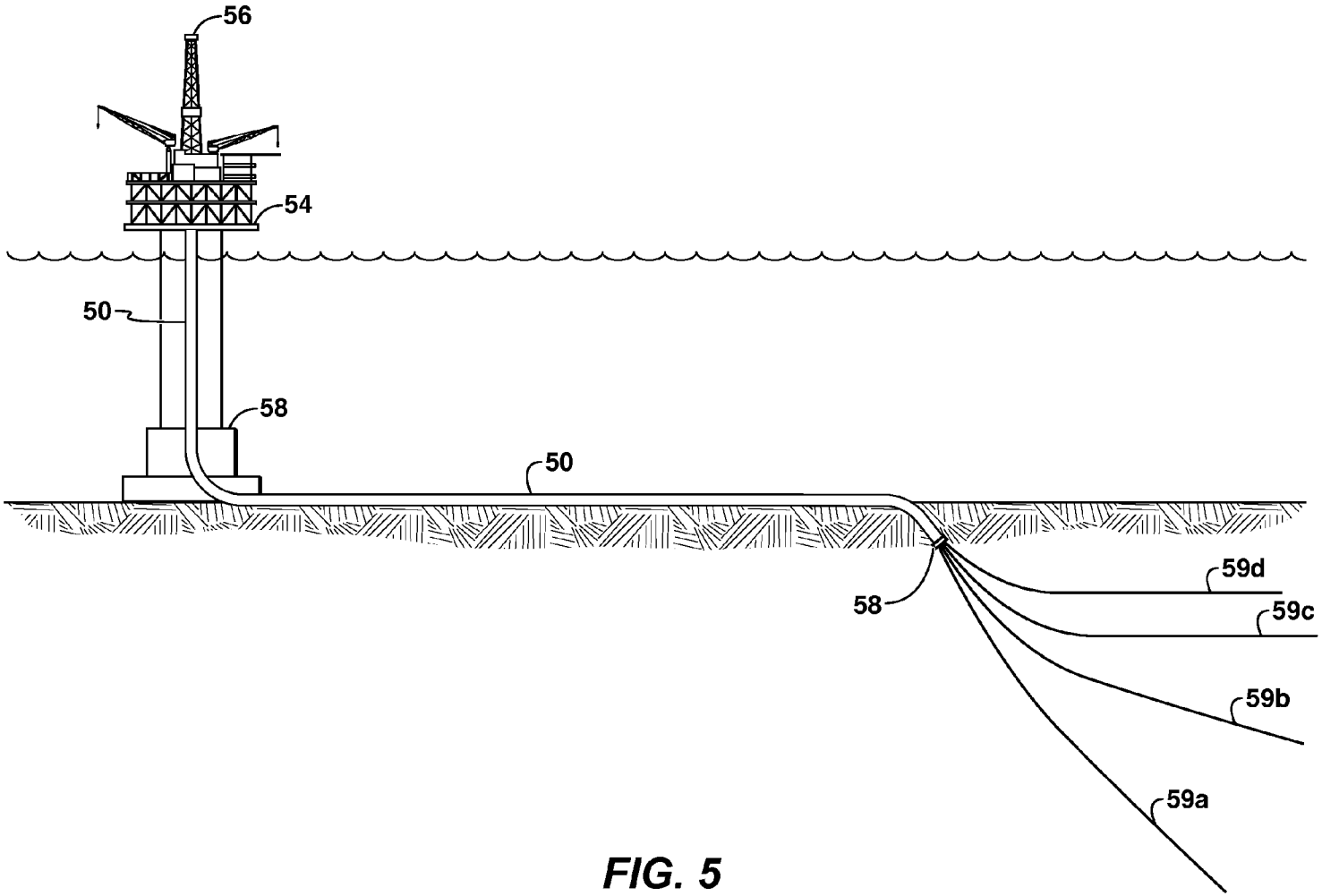
FIG. 5 illustrates an embodiment for drilling multiple wells through the same horizontal tubular.

In another embodiment of apparatus and method disclosed herein, illustrated in FIG. 5, multiple wells are drilled sequentially through the same horizontal tubular. Horizontal tubular 50 and a mud return line, such as shown in FIG. 2*a*, may be laid from platform 54, having drilling rig 56 to a preferred location. Selective whipstock 58 can be used to direct a drill string and casing strings in a selected direction when exiting horizontal tubular 50. Whipstock 58 may be controlled electrically or hydraulically from the surface. After a first well 59*a* or portion of a first well is drilled, whipstock 58 can be operated to make possible drilling of a second well, 59*b*. Subsequent operation of whipstock 58 may then allow drilling of wells 59*c*, 59*d* or other wells.

Figure 6:
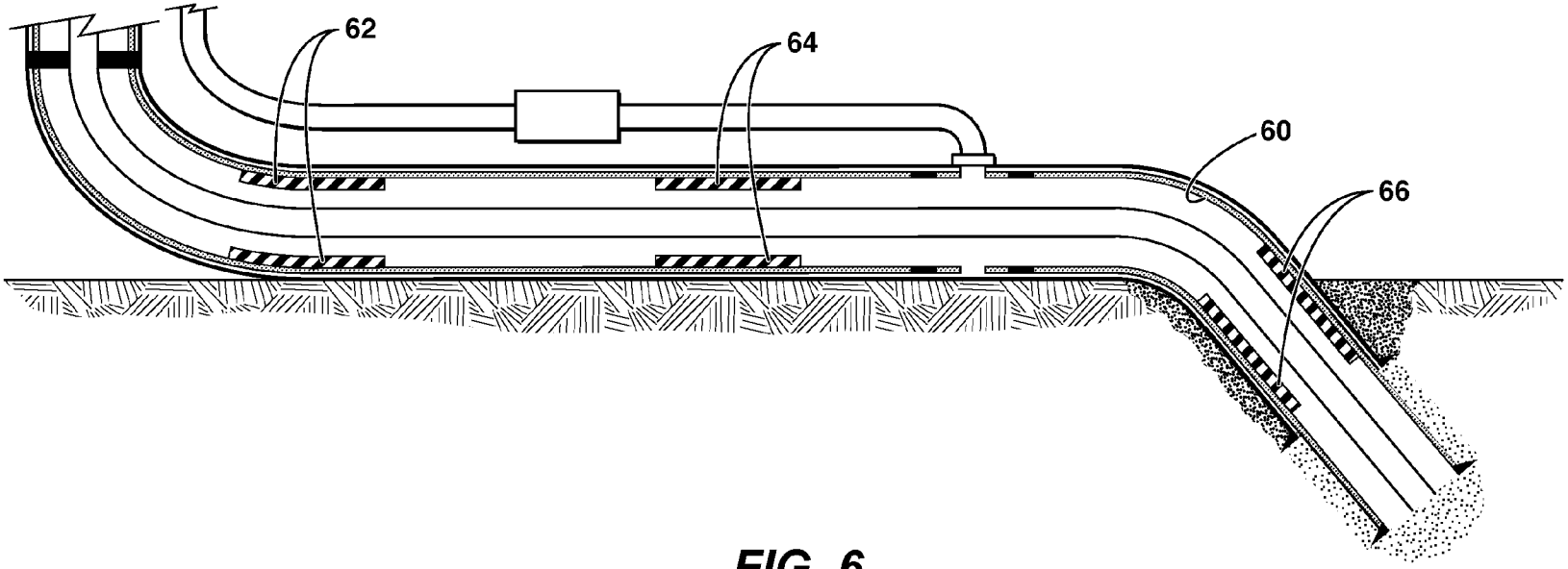
FIG. 6 illustrates one embodiment including sacrificial inner strings in the casing at selected locations.

To ensure that friction-induced wall loss from rotation or linear movement of drill strings does not compromise the pressure integrity of horizontal tubular 10 and/or casing strings in a well, sacrificial inner strings can be run to protect segments of a horizontal tubular conductor or casing, as illustrated in FIG. 6. Segments 62, 64 and 66 have been placed in casing 60. Segment 62 has been placed in the curved section near the proximal end of the casing, where it transitions from vertical to horizontal. Segment 64 has been placed at an intermediate location where curvature has been measured in the casing. Segment 66 has been placed near the distal end of the casing. These segments may be placed before the casing is put in place or they may be placed after the casing is in place using well-known techniques such as those used for casing patches. These inner segments may be removed prior to completing the well or may be replaced during drilling.

Figure 7:
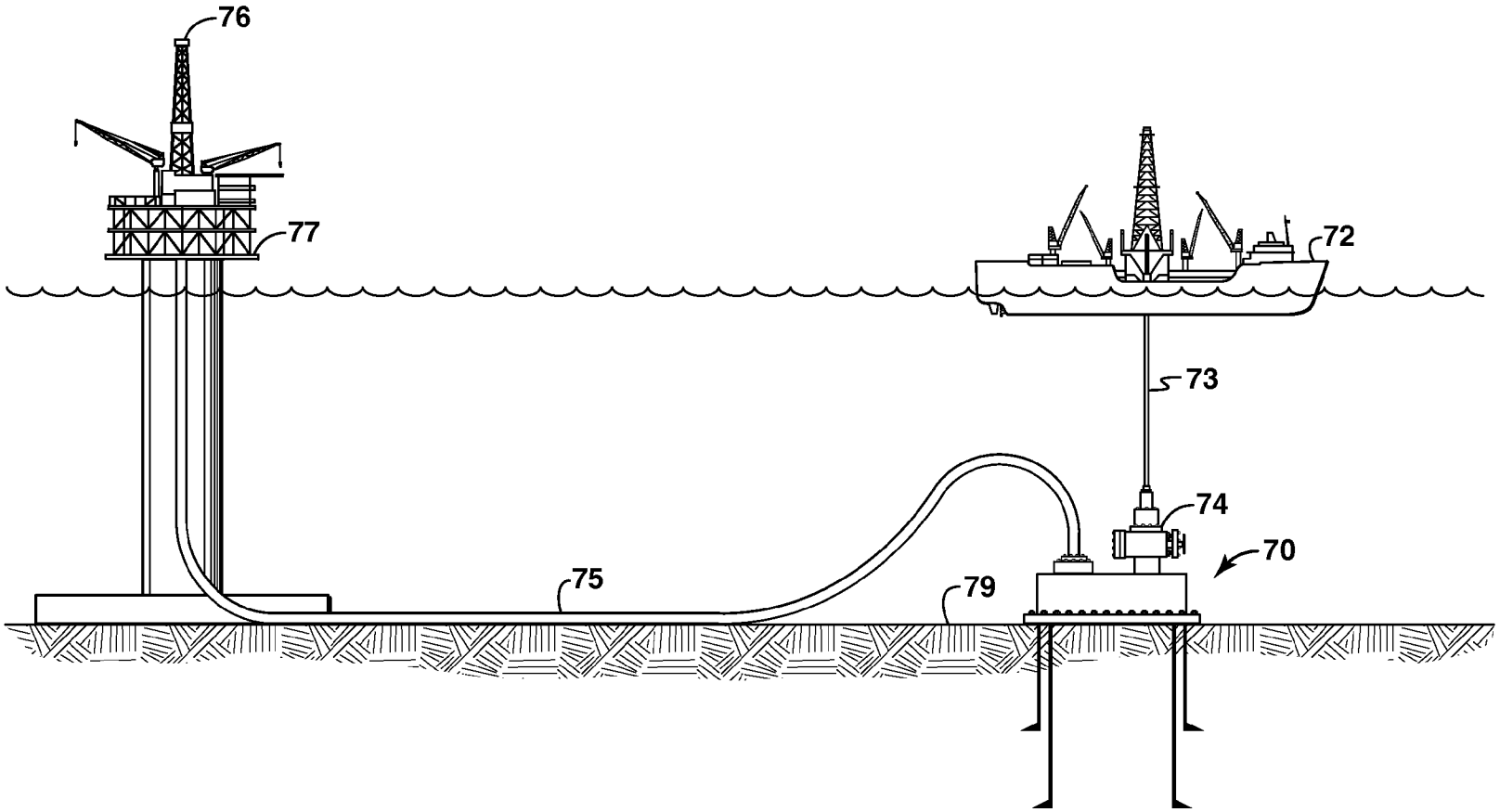
FIG. 7 illustrates a well having a vertical access tree, the well providing intervention access from a horizontal tubular conductor located above the mudline to an access point with the well at or near the mudline.

In another exemplary embodiment of horizontal tubular drilling, as disclosed herein, the upper section of offshore well 70 is partially drilled (e.g., the first one or two intervals) conventionally from floating drilling vessel 72, as illustrated in FIG. 7. The lower section(s) then may be drilled using horizontal tubular drilling. Well 70 has been drilled and cased to an intermediate depth. Horizontal tubular 75 has also been placed along seafloor 79 from drilling rig 76 on platform 77. A mud return line (not shown) as shown in FIG. 2*a* will also be installed before drilling of a lower section begins. Simultaneous activities from vessel 72 and rig 76 can decrease the overall time for well construction due to the use of simultaneous operations (SIMOPS). Also, this method would allow a smaller-diameter (e.g., 9⅝-inch) seafloor conductor and subsea wellhead to be used. The smaller diameter conductor would typically have a higher pressure rating. Also, the risk associated with running multiple casing strings through the long horizontal tubular conductor would be decreased.

Figure 8:
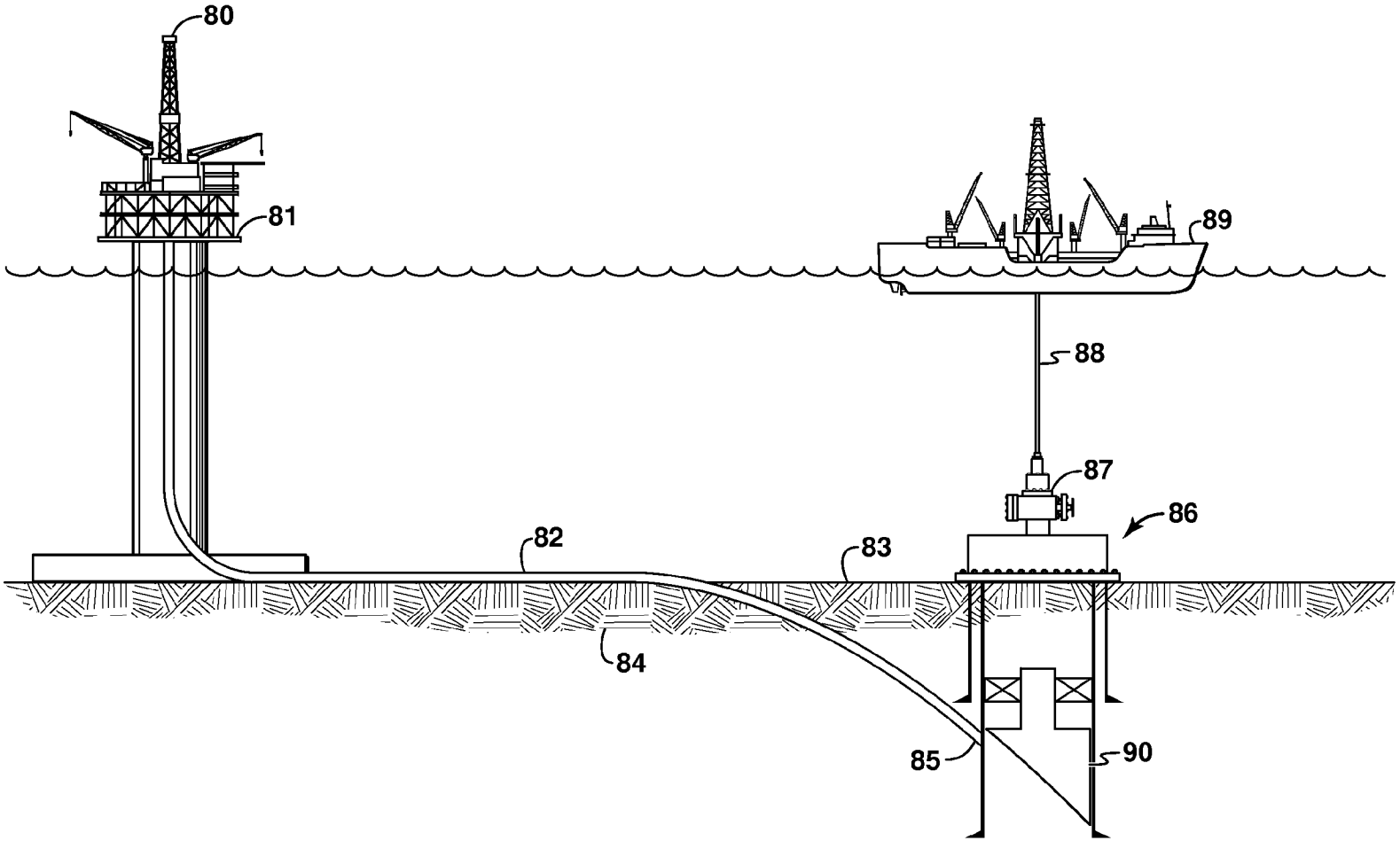
FIG. 8 illustrates a well having a vertical access tree, the well facilitating intervention from a second point of entry into the well significantly below the mudline, joining a horizontal tubular conductor.

A variation of the exemplary illustration of FIG. 7 is illustrated in exemplary FIG. 8, exhibiting joining horizontal tubular conductor 82 and well 86 in the subsurface 84 (e.g., below the seafloor) at junction 85 by adapting traditional concepts, methods, and techniques for constructing multilateral wells. This approach enables use of a less complex subsea tree 87. The joining is performed by intersecting the separate well paths performed by the service or drilling vessel 89 and the remote (e.g., jack-up, floating, ice-pack based or land-based) vessel or facility 80 respectively. In one exemplary embodiment, a retrievable whipstock 90 may be run into the vertical section of the well 86 to guide entry of the drillstring run through the horizontal tubular conductor to permit drilling of additional sections or intervals of the well. A permanent junction may be created by utilizing traditional techniques for running, cementing, and milling tubulars and equipment for multilateral wells.

In another embodiment, the invention may include a system for connecting a well with a drilling vessel for extended reach drilling operations comprising: a drilling rig; a horizontal tubular disposed to receive a drillstring from the drilling rig and extending from the drilling rig to a selected location; a mud return line connected to the horizontal tubular at a selected location along the horizontal tubular; a pump connected with the mud return line; and an inverted whipstock in the well; wherein the horizontal tubular connects with the well at a location in the well substantially at or below the whipstock. In other embodiments, the inventions may include the systems and methods discussed above, wherein 1) the horizontal member is connected to the well in proximity to a surface end of well, 2) the horizontal member is connected to the well at a location below a seafloor mudline; or 3) the horizontal member is connected to the well at a location below a seafloor mudline, and at or below a whipstock (e.g., an inverted whipstock, either retrievable or permanent) positioned within the well.

After a well is drilled to TD (Total Depth) and casing or liner is sealed in place in a borehole by cement or packers or both, the well is normally then "completed" so that production of hydrocarbons from the well can begin. Completion of wells usually includes the steps of perforating the casing or liner at depths where hydrocarbons are believed to be present, placing tubing and packers in the wells and placing a christmas tree on the well for connection to a flow line. Such techniques are well known in industry.

To facilitate intervention in horizontal tubular-drilled wells, the wells can be equipped with vertical access-trees. This would allow access to the well via a floating drilling unit, thus avoiding the requirement that completion and workover tools and fluids pass through the entire length of a horizontal tubular conductor.

We claim:

1. A system for extended reach drilling of a well, comprising:

a drilling rig;

a horizontal tubular disposed to receive a drillstring from the drilling rig and extending from the drilling rig to a selected location;

a mud return line connected to a port in the horizontal tubular;

a pump connected in the mud return line;

a casing string inside the horizontal tubular, the casing string having a mud return port disposed in proximity to the mud return line port in the horizontal tubular, and extending from a distal end of the horizontal tubular into the earth and a packer disposed outside the casing string at a location between the mud return line port in the horizontal tubular and a proximal end of the horizontal tubular; and a packer disposed outside the casing string at a location between the mud return line port in the horizontal tubular and the distal end of the horizontal tubular.

2. The system of claim 1 further comprising a valve for controlling flow through the mud return line port.

3. The system of claim 1, wherein the horizontal tubular is disposed along a seafloor.

4. The system of claim 1, wherein the horizontal tubular is disposed below a water surface at an angle in the range of from zero degrees to forty-five (45) degrees with respect to the water surface.

5. The system of claim 1 further comprising a sacrificial liner in at least a portion of the casing string disposed inside of the horizontal tubular.

6. The system of claim 1 further comprising a whipstock fixed at the distal end of the horizontal tubular.

7. The system of claim 1 further comprising a second drilling rig, a second horizontal tubular, and a second mud return line and pump such that the second rig can be used to drill a relief well in proximity to a primary well drilled using the drilling rig.

8. The system of claim 1 further comprising a liner having a liner top below the mud return port in the casing.

9. The system of claim 1, wherein the horizontal tubular is connected to the well in proximity to a surface end of the well.

10. The system of claim 1, wherein the horizontal tubular is connected to the well at a location below a seafloor mudline.

11. The system of claim 1, wherein the horizontal tubular is connected to the well at a location below a seafloor mudline, and at or below a whipstock positioned within the well.

12. A method for drilling a well having a surface location and a bottomhole location horizontally offset from the surface location, comprising:

supplying a drilling rig;

installing a horizontal tubular having a proximal end disposed to receive a drillstring from the drilling rig and extending to a selected location, the horizontal tubular having a port in proximity to a distal end;

installing a mud return line outside the horizontal tubular from the port in the horizontal tubular to the drilling rig and a pump for pumping mud through the return line;

connecting the mud return line to the horizontal tubular through the port in the horizontal tubular;

placing the drillstring through the horizontal tubular and drilling into the earth in a first selected direction to a selected first depth with the drillstring to form a first borehole;

placing a casing string having a packer thereon through the horizontal tubular to a selected location in the first borehole, the casing string having a port at a selected location, such that the port in the casing string is in proximity to the port in the horizontal tubular.

13. The method of claim 12 further comprising:

placing a segment of liner inside the casing string.

14. The method of claim 12 further comprising:

operating the pump to pump mud through the mud return line while drilling the first borehole.

15. The method of claim 12 further comprising installing a whipstock in the casing string to drill in another selected direction.

16. The method of claim 12 further comprising:

placing the drillstring through the first casing string and drilling into the earth to a selected second depth with the drillstring to form a second borehole;

placing a first liner through the first casing string to a selected location in the second borehole such that the liner top is disposed between the port in the first casing string and the distal end of the casing string; and sealing an annulus outside the first liner.

17. The method of claim 12 further comprising measuring pressure near the port in the horizontal tubular.

18. The method of claim 17 further comprising controlling the pump in response to the measured pressure.

19. The method of claim 16 further comprising drilling a third borehole below the first casing and placing a liner in the third borehole such that the liner top is between the port in the first casing string and the distal end of the first casing string.

20. The method of claim 12, wherein the horizontal tubular is connected to the well in proximity to a surface end of the well.

21. The method of claim 12, wherein the horizontal tubular is connected to the well at a location below a seafloor mudline.

22. The method of claim 15, wherein the horizontal tubular is connected to the well at a location below a seafloor mudline, and at or below the whipstock positioned within the well.

23. A method for producing hydrocarbons from an oil and gas reservoir, comprising:

using the method of claim 12;

placing the drillstring through the casing string and drilling into the earth to a depth where the earth contains hydrocarbons to form a bottom borehole;

placing a liner or casing to a desired depth and sealing the liner or casing in the well;

completing the well; and producing hydrocarbons from the well.

24. A method for drilling a well, comprising:

supplying two drilling rigs;

installing two horizontal tubulars disposed to receive a drillstring from each of the drilling rigs and extending from each drilling rig to a selected location;

installing a mud return line from each of the drilling rigs to a selected location along each of the horizontal tubulars and connecting the mud return lines through a mud return line port in each of the horizontal tubulars, each of the mud return line ports being controlled by a valve;

installing a pump and power for the pump, the pump being connected in at least one of the mud return lines;

operating the pump to deliver mud to a selected drilling rig;

a casing string inside at least one of the horizontal tubulars, the casing string having a casing mud return port disposed in proximity to the mud return line port in the at least one horizontal tubular, and extending from a distal end of the at least one horizontal tubular into the earth and a packer disposed outside the casing string at a location between the mud return line port in the at least one horizontal tubular and a proximal end of the at least one horizontal tubular; and a packer disposed outside the casing string at a location between the mud return line port in the at least one horizontal tubular and the distal end of the at least one horizontal tubular.

25. A method for drilling multiple wells, comprising:

supplying a drilling rig;

installing a horizontal tubular disposed to receive a drillstring from the drilling rig and extending from the drilling rig to a selected location, the horizontal tubular having a whipstock at a distal end oriented to direct tubulars in a first direction from the distal end of the horizontal tubular;

installing a mud return line from the drilling rig to a selected location along the horizontal tubular and connecting the mud return line through a port in the horizontal tubular, the port being controlled by a valve;

installing a pump and power for the pump, the pump being connected in the mud return line; and operating the pump to deliver mud to the drilling rig at a selected rate while drilling a first well in the first direction from the distal end of the horizontal tubular;

operating the whipstock to direct tubulars in a second direction from the distal end of the horizontal tubular; and operating the pump to deliver mud to the drilling rig at a selected rate while drilling a second well in the second direction from the distal end of the horizontal tubular.

26. A method for drilling a lower section of a well, comprising:

drilling and casing an upper section of the well using a first drilling rig;

supplying a second drilling rig;

installing a horizontal tubular disposed to receive a drillstring from the second drilling rig to the upper section of the well;

installing a mud return line, having a pump therein and power for the pump, from the second drilling rig to a selected location along the horizontal tubular and connecting the mud return line through a mud return line port in the horizontal tubular;

operating the pump to deliver mud to the drilling rig at a selected rate while drilling a first well from the distal end of the horizontal tubular.

27. The method of claim 26 wherein the pump is operated in response to a pressure in the mud return line.

28. A system for connecting a well with a drilling vessel for extended reach drilling operations comprising:

a drilling rig;

a horizontal tubular disposed to receive a drillstring from the drilling rig and extending from the drilling rig to a selected location, a distal end of the horizontal tubular connecting with the well;

a mud return line connected to the horizontal tubular at a mud return line port positioned at a selected location along the horizontal tubular;

a pump connected with the mud return line; and a casing string having a packer thereon, the casing string positioned within at least a portion of the horizontal tubular and the casing string extending through the distal end of the horizontal tubular to a selected location in a first borehole, the casing string having a mud return port at a selected location, such that the packer is positioned along the casing string between a proximal end of the horizontal tubular and the mud return line port in the horizontal tubular.

* * * * *